US006157806A

United States Patent [19]

Elbert et al.

[11] Patent Number: 6,157,806

[45] Date of Patent: Dec. 5, 2000

[54] FUSER SYSTEM WITH GREASED BELT

[75] Inventors: Donald Leo Elbert, Lexington; Cory Nathan Hammond, Winchester; Kevin Dean Schoedinger, Nicholasville; Jerry Wayne Smith, Irvine; Robert Glenn Smith, Georgetown, all of Ky.

[73] Assignee: Lexmark International, Inc., Lexington, Ky.

[21] Appl. No.: 09/491,720

[22] Filed: Jan. 27, 2000

[51] Int. Cl.[7] ..... G03G 15/20; H05B 1/00

[52] U.S. Cl. ..... 399/329; 399/333; 219/216

[58] Field of Search ..... 219/216; 399/320, 399/324, 325, 328, 329, 330, 333; 428/421, 422, 423.1, 447; 432/59

[56] References Cited

U.S. PATENT DOCUMENTS

| | | | |
|---|---|---|---|
| 4,375,505 | 3/1983 | Newkirk | 430/99 |
| 5,300,999 | 4/1994 | Koh et al. . | |
| 5,547,759 | 8/1996 | Chen et al. | 428/421 |
| 5,765,085 | 6/1998 | Law et al. | 399/329 |
| 5,852,763 | 12/1998 | Okuda et al. . | |
| 5,956,555 | 9/1999 | Chen et al. | 399/329 |
| 6,002,910 | 12/1999 | Eddy et al. | 399/329 |

*Primary Examiner*—Arthur T. Grimley
*Assistant Examiner*—Hoang Ngo
*Attorney, Agent, or Firm*—John A. Brady

[57] ABSTRACT

Wear of the belt (1) of a belt fuser is minimized by use of a high viscosity lubricant of perfluoropolytrimethylene oxide grease between the inside of the belt and the heater element 6. To avoid damage of the belt at turn on, the belt is heated to a predetermined temperature before force is applied to move the belt.

10 Claims, 2 Drawing Sheets

FUSER SYSTEM WITH GREASED BELT

TECHNICAL FIELD

This invention relates to belt fusers for imaging apparatus. Such fusers have a thin, low-thermal-retention belt, which receives heat from a heating element as the belt moves with paper through a fusing nip. Such belts are known which carry a lubricant or grease to facilitate such movement.

BACKGROUND OF THE INVENTION

The belts of such fusers typically have an outer layer of material which tends to release toner from the belt, as the objective is for the belt to heat the toner while leaving it on the paper or other media being operated upon. Typically this outer layer is a low surface energy polymer, such as PTFE (polytetrafluoroethylene), PFA (perfluoroalkoxy vinyl polytetrafluoroethylene copolymer) or a physical blend of PTFE and PFA. Such a layer is particularly subject to damage and removal by wear.

Adequate lubrication reduces the force to move the belt and therefore reduces wear on the outer layer. However, a lubricant having high viscosity at cold and low standby temperatures is employed because a less viscous lubricant, such as an oil, will flow outward away from the fuser and will therefore not be in place for subsequent starts of the fuser. A less viscous lubricant typically is not retained for an extended period on the bell because of movement and because of the effects of heat.

U.S. Pat. No. 5,852,763 to Okuda et al. is illustrative of belt fusers to which this invention is directed and discusses relevant belts and the grease in some detail. However, it does not recognize that the high viscosity of the grease in a cold condition results in excessive forces on the outer, release surface resulting in significant wear. This invention is direct to reducing damage from such wear.

U.S. Pat. No. 5,300,999 to Koh et al. Also discusses lubrication of a belt fuser with regard to heating operation and grease viscosity. Temperature detection is coupled to a time delay scheme in order to lower grease viscosity by delaying start up torque. The patent also does not recognize that the high viscosity of the grease in a cold condition results in excessive forces on the outer, release surface, resulting in significant wear. Since this patent teaches replenishment of its lubricant during use, the lubricant used is apparently of low viscosity or low stability.

Known prior art greases for belt fusers include perfluoro-(ethylene oxide/methylene oxide) copolymer thickened with 0.2 micron spherical polytetrafluoroethylene particles. This invention employs a different perfluoro polymer which, when used in a system having preheating, achieves full function without significant wear on the belt or loss of the lubricant.

DISCLOSURE OF THE INVENTION

In accordance with this invention a grease is employed which has a long functional life. That grease is perfluoropolytrimethylene oxide thickened with polytetrafluoroethylene particles. The data processing control of the fuser includes determining the impeding initiation of movement of the belt when the belt is at cold or low temperature status. The data processing control initiates the generation of heat in the fuser with the belt drive not initiated. After reaching a predetermined condition consistent with the grease being warmed to a suitable, low viscosity, the control initiates the movement of the belt for use in an ordinary fixing operation.

Since typically the fuser has a temperature sensor for control of the operating temperature, the predetermined condition may be the sensing of a predetermined temperature by that temperature sensor.

An additional advantage of this grease is that it is not degraded by contact with metal oxide ceramic (typically aluminum oxide), while prior art similar ethylene oxide/methylene oxide greases are so degraded.

BRIEF DESCRIPTION OF THE DRAWINGS

The details of this invention will be described in connection with the accompanying drawings, in which.

DESCRIPTION OF THE PREFERRED EMBODIMENTS

Figure 1:
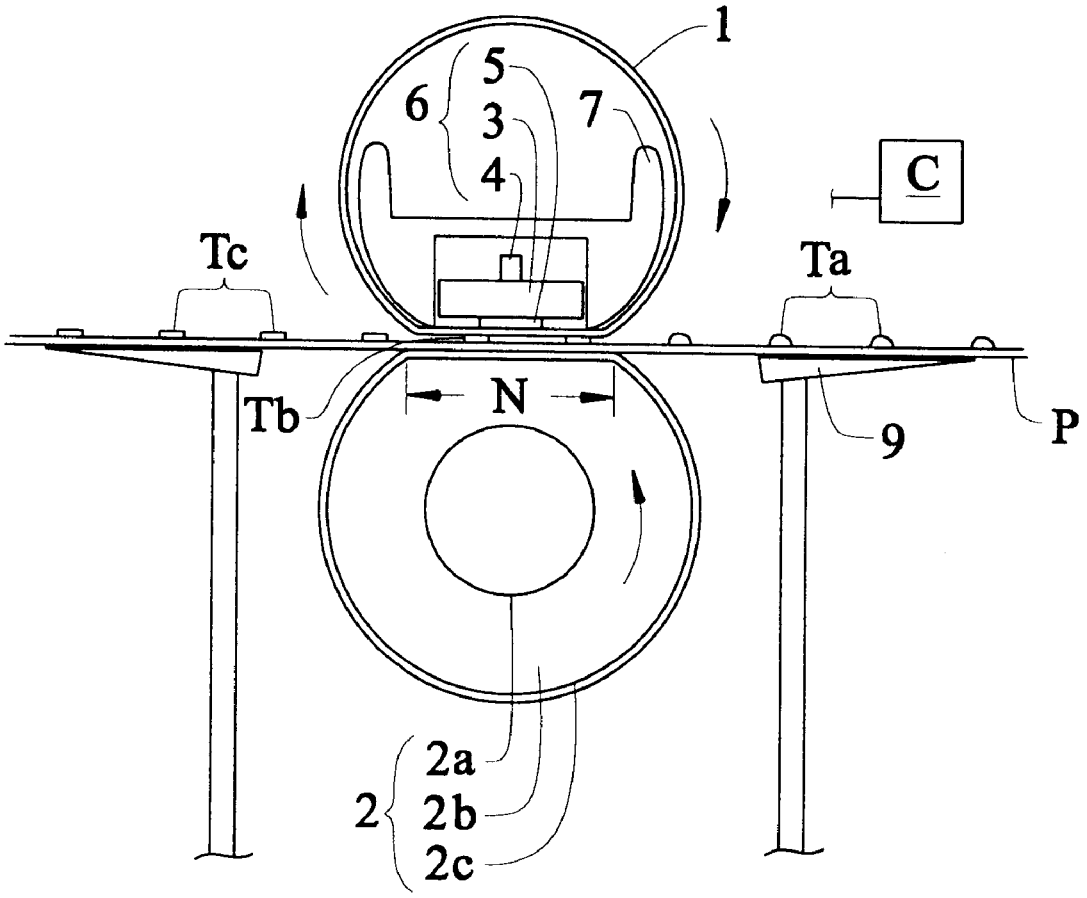
FIG. 1 is a side, cross-sectional view of a thin film belt fuser consistent with this invention.

Referring to FIG. 1, there is shown an image heating/fixing apparatus using a film bell and a ceramic heater according to an embodiment of the present invention. Designated by reference number 1 is a fixing film in the form of an endless belt 1. Pressing roller 2 consist. of shaft 2*a* typically formed from steel, aluminum, or similar metal; a rubber elastic layer 2*b* made of silicon rubber, and surrounded by parting layer 2*c*, typically consisting of a PFA sleeve. Pressing roller 2 is urged to the bottom surface of beater 6 by a resilient member or other urging means (not shown) providing force of about 4 to 7 kilograms with a bottom travel portion of belt 1 interposed between heater 6 and pressing roller 2. Roller 2 is driven by an attached gear (not shown) through connection with a gear series to the printer mechanism gear train. Movement of film 1 is driven by pressing roller 2 and is in the clockwise direction, thereby moving media P in the corresponding direction through the nip formed by belt 1 and pressing roller 2

Belt 1 is an endless tube, which is rotated by contact with driven pressing roller 2 repeatedly for fixing a toner image. Belt 1 is therefore made of a highly heat resistive and durable material having good parting properties and a total thickness of not more than about 100 microns, preferably less than about 55 microns. The body of belt 1 is a polyimide resin or the like. To facilitate parting of media P, leaving toner on media P, film 1 typically has an outer layer (not separately shown) of low surface energy material such a PTFE, PFA, a physical blend of the two, or similar fluoropolymer. On the lower, opposite surface of belt 1, the surface which contacts the surface of heater 6, a layer of high viscosity lubricant or grease (not separately illustrated) is applied. The outer layer and the amount of grease are thin in relation to total thickness of belt 1, the exact amounts being a routine matter of design choice for specific materials and intended length of service.

Heater 6 comprises, as major components, a heater substrate (base member) 3, typically of ceramic, extending in a direction substantially perpendicular to the direction of movement of belt 1. Base member 3 is electrically insulative, has a high thermal conductivity, and has high heat resistance, as well as a low thermal capacity. One or more heat-generating electrical resistors 5 in a line or stripe extend along the length of base member 3 on the lower surface of base member 3 (i.e., along the face of heater 6 which directly contacts film 1), and a temperature detecting element 4, for example, a thermistor or thermostat, is mounted in contact with the back face of base member 3 (opposite the face having heat-generating resistors 5). The thermal capacity (heat retention) of the heater 6, as whole, is low. Heater 6 is fixed to a holder 7 with the bottom face of heater 6 facing the nip which receives media P. A thin layer of electrical insulation, such a glass (not shown), covers the heat generating resistor 5 portion of the bottom face of heater 6, thereby coming in direct contact with belt 1 on the side opposite the outer, parting layer of belt 1.

The grease is applied only in sufficient amount to coat the entire inside surface of belt 1. Initially the full amount for that purpose may be applied during manufacture on the bottom face of heater 6. Belt 1 is then placed around heater 6 . The grease will be distributed to coat the full inside surface of belt 1 during normal use.

The grease is high viscosity perfluoropolytrimethylne oxide (a repeating polymer of three fully fluorinated methylene moieties in a straight chain terminated by an oxygen) thickened with polytetrafluoroethylene spherical particles of generally 0.2 micron diameter. The preferred grease is commercially available DEMNUM L200 grease, a product of Daikin Industries, Ltd., of Japan. It is the highest viscosity grease of that category, having an apparent (mPa s) (milli Pascal seconds) viscosity of 5300 at 250 degrees C. at shear rate of 300 per second, higher than the viscosity of 3300 mPa s of the next grease in that category at the same conditions.

In accordance with this invention, damage which would otherwise occur to film 1 is avoided by preheating as described below, resulting in elimination of significant wear on the lower surface of belt 1 during extended operations of the fuser.

Operation is under control of an electronic data processor such as microprocessor C, shown illustratively. Upon generation of an image formation start signal, an image-forming sequence is carried out under control of processor C in an image-forming station (not shown), and recording media P is supplied to the fixing device guided by an inlet guide 9, and is introduced into a nip N (fixing nip) between the temperature-controlled heat 6 and pressing roller 2, more particularly, between fixing belt 1, and pressing roller 2. Media P is passed through fixing nip N at the same speed as belt 1 is moved with the surface of media P having an unfixed toner image Ta being contacted with the bottom surface of belt 1, which is moving in the same direction as media P. Tb is toner in nip N. Loose toner Ta is fused onto media P such as paper, to form fixed toner Tc.

Figure 2:
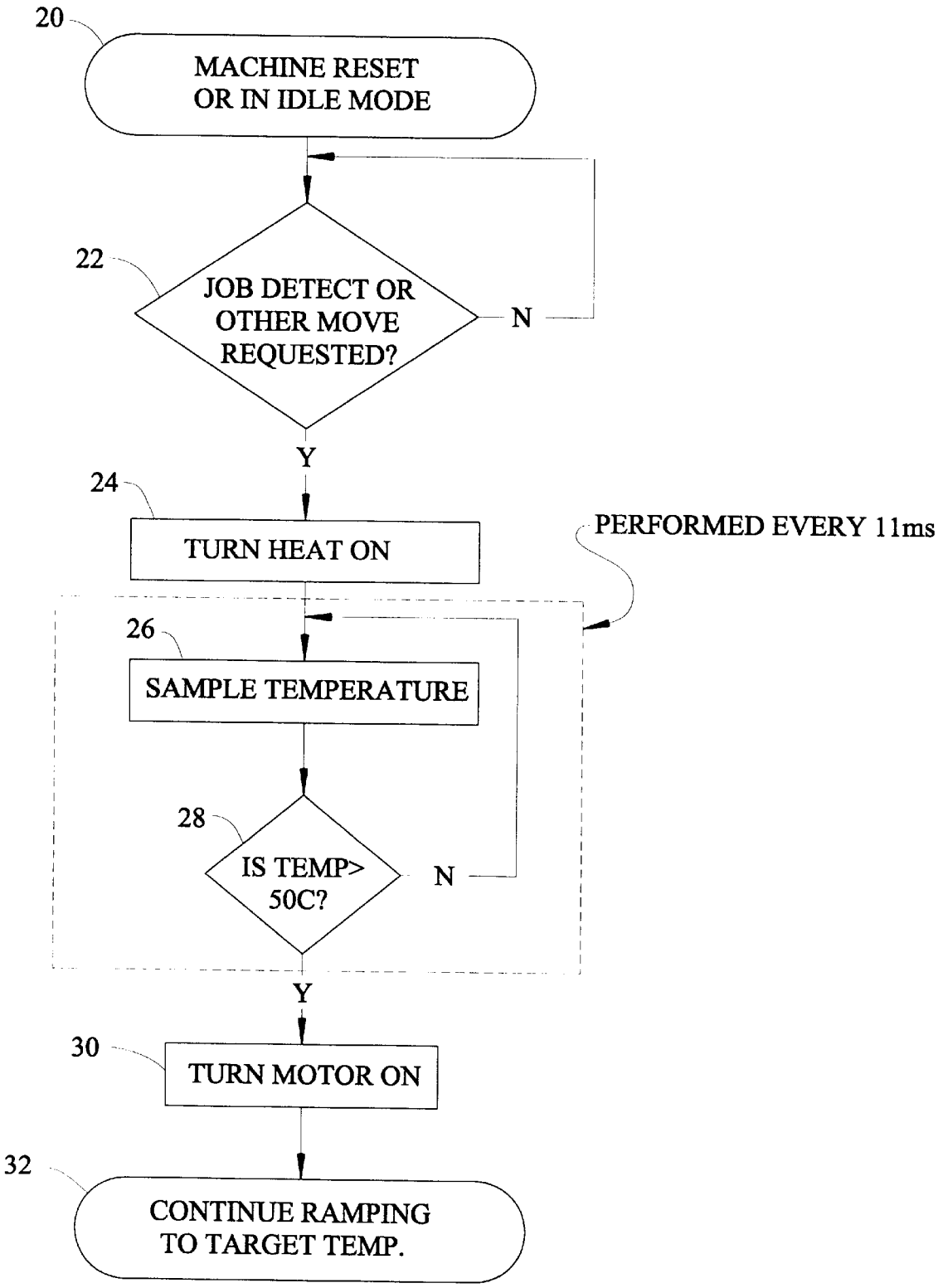
FIG. 2 illustrates a system of control of a belt fuser in accordance with this invention.

With reference to FIG. 2, the control operation sequence is initiated from a status of the machine being turned on or activated from a low temperature idle, status 20 in FIG. 2 (machine reset being a status indicative of turn on from off). Action 22 then determines when a print operation (print job) of other movement of the belt 1 is to be conducted. If no, action 22 is repeated. When action 22 detects yes, action 24 activates resistors 5 to begin heating of the fuser. Temperature is then sampled in action 26 using sensor 4. The temperature is monitored as less than 50 degrees C. in action 28. When action 28 is no, sampling is done again by action 26, this being at 11 millisecond intervals. When action 28 is yes, a motor (not shown) is turned on in action 30 to drive lower roller 2, which advances belt 1 as described. Resistors 5 continue to be driven up to fixing temperature (target temperature) in action 32.

Long life of the fixing system comparable to the full potential life of a laser printer can be realized when the lubricant as described in the foregoing is used in connection with the controlled delay of starting movement as discussed. An additional advantage of this grease is that it is not degraded by contact with metal oxide ceramic, such as aluminum oxide of a specific embodiment of this invention, while similar ethylene oxide/methylene oxide greases are so degraded.

Variations and alternatives consistent with the invention will be apparent.

We claim:

1. A toner fixing system comprising:

an electronic data processing controller;

a low heat capacity heating element to generate heat under control of said controller;

a belt with a surface in contact with said heating element movable in contact with said heating element under control of said controller;

a back up member in nip position with said belt where said belt contacts said heating element;

a media feed path to feed media carrying unfixed toner images through said nip; and a normally viscous lubricant of perfluoropolytrimethylene oxide on the side of said belt which contacts said heating element, said controller at initiation of said fixing system from a status in which said heating element normally is cold or substantially cold initiating heating of said heating element while said movement of said belt is not activated, followed by initiating of said movement of said belt when said lubricant is substantially heated wherein wear at the surface of said belt which contacts said heating element is reduced.

2. The fixing system as in claim 1 in which said surface of said belt which contacts said heating element comprises a fluoropolymer.

3. The fixing system as in claim 1 in which said lubricant contains thickener of polytetrafluoroethylene particles.

4. The fixing system as in claim 2 in which said lubricant contains thickener of polytetrafluoroethylene particles.

5. The fixing system as in claim 3 in which said lubricant has apparent viscosity of above 3300 mPa s at 250 degrees C. at shear rate of 300 per second.

6. The fixing system as in claim 4 in which said lubricant has apparent viscosity of above 3300 mPa s at 250 degrees C. at shear rate of 300 per second.

7. The fixing system as in claim 3 in which said particles are spherical of generally 0.2 micron diameter.

8. The fixing system as in claim 4 in which said particles are spherical of generally 0.2 micron diameter.

9. The fixing system as in claim 5 in which said particles are spherical of generally 0.2 micron diameter.

10. The fixing system as in claim 6 in which said particles are spherical of generally 0.2 micron diameter.

* * * * *